US006940496B1

(12) United States Patent
Kim

(10) Patent No.: US 6,940,496 B1
(45) Date of Patent: Sep. 6, 2005

(54) DISPLAY MODULE DRIVING SYSTEM AND DIGITAL TO ANALOG CONVERTER FOR DRIVING DISPLAY

(75) Inventor: Eun-Gu Kim, Cupertino, CA (US)

(73) Assignee: Silicon, Image, Inc., Sunnyvale, CA (US)

( * ) Notice: Subject to any disclaimer, the term of this patent is extended or adjusted under 35 U.S.C. 154(b) by 0 days.

(21) Appl. No.: 09/326,503

(22) Filed: Jun. 4, 1999

Related U.S. Application Data

(60) Provisional application No. 60/088,128, filed on Jun. 4, 1998.

(51) Int. Cl.[7] ..... G09G 5/00

(52) U.S. Cl. ..... 345/204; 345/98; 345/100; 345/103; 345/212; 345/800; 315/169.1; 315/170; 712/10; 712/11; 341/144; 358/236

(58) Field of Search ..... 345/204, 151, 345/152, 154, 100, 103, 800, 98, 212; 315/169.1, 170; 712/10, 11; 341/144; 348/536

(56) References Cited

U.S. PATENT DOCUMENTS

| | | | | | |
|---|---|---|---|---|---|
| 4,899,310 | A | * | 2/1990 | Baba et al. | 365/189.05 |
| 4,918,436 | A | * | 4/1990 | Johary | 345/540 |
| 4,953,101 | A | * | 8/1990 | Kelleher et al. | 364/518 |
| 4,963,860 | A | | 10/1990 | Stewart | 340/719 |
| 5,109,480 | A | * | 4/1992 | Sone et al. | 345/589 |
| 5,117,468 | A | * | 5/1992 | Hino et al. | 382/205 |
| 5,170,158 | A | * | 12/1992 | Shinya | 358/241 |
| 5,406,304 | A | | 4/1995 | Shirayama | 345/98 |
| 5,444,457 | A | * | 8/1995 | Hotto | 345/148 |
| 5,614,922 | A | * | 3/1997 | Kawaguchi et al. | 345/89 |
| 5,657,040 | A | | 8/1997 | Kanbara | 345/98 |
| 5,805,117 | A | * | 9/1998 | Mazurek et al. | 345/1.3 |
| 6,049,321 | A | * | 4/2000 | Sasaki | 345/99 |
| 6,061,046 | A | * | 5/2000 | An | 345/98 |
| 6,067,383 | A | * | 5/2000 | Taniguchi et al. | 382/240 |
| 6,133,895 | A | * | 10/2000 | Huang | 345/94 |
| 6,201,529 | B1 | * | 3/2001 | Shimizu | 345/150 |
| 6,222,511 | B1 | | 4/2001 | Stoller et al. | 345/60 |
| 6,232,937 | B1 | * | 5/2001 | Jacobsen et al. | 345/87 |
| 6,335,720 | B1 | * | 1/2002 | Mori et al. | 345/98 |
| 6,608,704 | B2 | * | 8/2003 | Kurosawa et al. | 358/468 |

FOREIGN PATENT DOCUMENTS

| | | | |
|---|---|---|---|
| WO | WO 98/12695 | 3/1998 | G09G/3/36 |

* cited by examiner

*Primary Examiner*—Xiao Wu
*Assistant Examiner*—Abbas Abdulselam
(74) *Attorney, Agent, or Firm*—Perkins Coie LLP

(57) ABSTRACT

A display module driving system wherein digital pixel data for an image to be displayed is provided to a plurality of column drivers on a row by row basis in serial format over a plurality of dedicated bus lines rather than a single parallel bus line. Digital pixel data for a complete image row is divided into segments, wherein the number of segments is each to the number of column drivers. Each segments is then serialized and transmitted to a corresponding column driver such that the digital pixel data for an entire row is transferred to each of the plurality of column drivers at the same time. The column drivers receive the segments and rearrange the data into parallel. The pixels are then transferred to a digital to analog converter, preferably two pixels at a time, where each pixel is converted into analog red, green and blue signals. An analog sample and hold module samples each analog signal for all of the pixels in a given row of the display and stores the signals in first capacitors of a plurality of sample and hold capacitor pairs. The sample and hold capacitor pairs allow analog signals to be sampled and held on a row by row basis such that when one capacitor in each pair stores one of the analog red, green and blue voltages for a subsequent row, the other capacitor transfers the analog voltage signal out for a current row to the column electrodes of the display.

21 Claims, 8 Drawing Sheets

DISPLAY MODULE DRIVING SYSTEM AND DIGITAL TO ANALOG CONVERTER FOR DRIVING DISPLAY

CROSS-REFERENCE TO RELATED APPLICATION

Under 35 U.S.C. 119(*e*), this application claims the benefit of U.S. Provisional Application No. 60/088,128, which was filed on Jun. 4, 1998.

FIELD OF THE INVENTION

The invention is related to the field of drive systems for an active matrix (thin-film transistor) liquid crystal display. More particularly, the invention relates to a drive system which serially transfers segments of digital pixel data to multiple column drivers over separate serial bus lines, wherein the column drivers arrange the segments of digital pixel data in parallel, convert the segments into analog signals, and sample the analog signals for driving column electrodes of an active matrix liquid crystal display.

BACKGROUND OF THE INVENTION

With recent progress in various aspects of active matrix (thin-film transistor) liquid crystal display technology, the proliferation of active matrix displays has been spectacular in the past several years. In an active matrix display, there is a gate comprised of one transistor or switch corresponding to each display cell in the matrix. An active matrix display is operated by first applying select voltages to a row electrode to activate the gates of that row of cells, and second applying appropriate analog data voltages to the column electrodes to charge each cell in the selected row to a desired voltage level.

Typically, active matrix liquid crystal displays include drive systems which drive analog data voltages to the column electrodes using column drivers. Multiple column drivers are used to support all of the rows in the display. For example, in a matrix display having pixel dimensions of 1024×768, there are actually 3072 subpixels or display cells per row (each pixel having a red subpixel, a green subpixel, and a blue subpixel). Accordingly, there may be up to eight column drivers needed for such a display, with each column driver preferably supporting 384 subpixels or display cells. Typically, each subpixel is represented by digital pixel data having a bit depth of six or eight bits. Bit depth indicates the number of bits available per subpixel to control the brightness of the red, green or blue displayed for that subpixel. Pixel depth may vary depending upon the drive system. Accordingly, in a conventional drive system, each column driver is loaded with at least 2304 bits (6 bits per subpixel× 384 subpixels). Bits are all loaded into the column drivers sequentially over a single parallel bus line, such that each column driver is loaded one after the other.

Once all bits for 384 subpixels have been loaded into any one column driver, a digital storage register is used to hold the digital pixel data until all eight column drivers are loaded. After all eight column drivers have been loaded, the digital pixel data for each subpixel is converted into an analog red, green or blue signal. This is typically accomplished by using one digital to analog converter per subpixel in each column driver. Accordingly, each column driver is required to have 384 digital to analog converters. The converters may be eight bit or six bit converters depending upon the bit depth of the drive system. Thus, this requires a large number of digital to analog converters, with each converter occupying a significant amount of die space depending upon whether it is a six bit or eight bit converter. Moreover, in a conventional embodiment, the digital to analog converters are designed to all operate at the same rate such that all RGB analog signals are produced for all 384 subpixels at the same time. Accordingly, such designs are extremely difficult and highly expensive.

Once all column decoders have converted the digital pixel data for each subpixel into RGB analog signals, the analog signals are typically passed through a buffer in order to generate sufficient current for driving the column electrodes of an active matrix liquid crystal display.

FIG. 1 illustrates a conventional active matrix liquid crystal display drive system. As shown, the conventional system includes an active matrix liquid crystal display 100 having a resolution of 1024 pixels×768 pixels. The display is driven by gate modules 180*a* through 180*d* and column drivers 160 through 160*h*. Due to spatial limitations, FIG. 1 only shows column drivers 160*a*, 160*b*, 160*c* and 160*h*; however, it is understood that in a conventional drive system for driving a display of resolution 1024 pixels×768 pixels, eight column drivers are used, with each column driver supporting 384 subpixels or memory cells. As shown in FIG. 1, a timing controller 110 is coupled to each of the column drivers 160*a* through 160*h* through a parallel data bus line 150. The timing controller 110 is also coupled to each of the gate modules 180*a* through 180*d* for providing row voltages in order to activate the display cells in each row.

The timing controller 110 provides digital display data, for an image to be displayed, to the column drivers in the form of digital pixel data on a row by row basis. The digital pixel data is provided in parallel using the parallel data bus line 150. A master clock signal MCLOCK 112 is used to control the rate at which the digital pixel data is transferred over the parallel data bus line 150. The timing controller 110 receives digital display data, for an image to be displayed, from some external source one display row of information at a time and stores the information. The external source may be a hard disk drive in a computer, a CD-Rom drive, a flash memory card or some other appropriate external storage device. Alternatively, the external source may be consist of an intranet or the internet. The digital display data is received as digital pixel data. The timing controller 110 stores the digital pixel data in a memory array (not shown) within the timing controller. The timing controller 110 then transfers the digital pixel data out to the column drivers 160*a* through 160*h*, in parallel using the parallel data bus line 150 and the master clock MCLOCK signal 112. As each row of the image to be displayed is transferred out to the column drivers over the parallel data bus line 150, a next row of digital pixel data is received and stored in the internal memory of the timing controller 110.

Each pixel supports a red subpixel, a green subpixel and a blue subpixel. In most video display applications, each pixel has a six or eight bit pixel depth. This means that each red, green and blue subpixel requires six or eight bits, such that the parallel data bus line 150 must be 36 or 48 bit lines wide. This is because the digital pixel data is typically transferred over the parallel data bus line 150 two pixels at a time—i.e. two pixels per MCLOCK pulse at a clock rate of 65 MHz for six bit pixel depth applications. Accordingly, in the prior art drive system illustrated in FIG. 1, the parallel data bus line 150 is shown as a thirty-six bit bus line, which transfers two eighteen bit pixels at a time (R0 (5:0), G0 (5:0), B0 (5:0)) and (R1 (5:0), G1 (5:0), B1 (5:0)) per MCLOCK signal pulse at a clock rate of 65 MHz.

Each of the column drivers 160*a* through 160*h* is coupled to the parallel data bus line 150. In the prior art, the column drivers 160*a* through 160*h* are loaded with the digital pixel data sequentially, receiving two pixels at a time. Accordingly, in the prior art drive system of FIG. 1, the first column driver 160*a* is loaded with digital pixel data from the controller 100 until all 384 subpixels have been loaded into the first column driver 160*a*. A shift register or some other appropriate device is preferably used to track the loading process. Once the first column driver 160*a* has been fully loaded, an enable signal 165 is then activated from the first column driver 160*a* to the second column driver 160*b*, thereby allowing the second column driver 160*b* to begin downloading digital pixel data from the parallel data bus line 150. Again, the second column driver 160*b* includes a shift register or some other appropriate device to track the loading process. Once the second column driver 160*b* has loaded all 384 subpixels, its enable signal 165 is activated from the second column driver 160*b* to the third column driver 160*c*, thereby allowing the third column driver 160*c* to begin downloading digital pixel data from the parallel data bus line 150. This process continues until all of the column drivers have been loaded.

Once all of the column drivers 160*a* through 160*h* have been loaded. The timing control sends a load signal 115 to each of the column drivers 160*a* through 160*h* instructing them to begin converting the digital pixel data for each subpixel into analog red, green or blue signals. The digital pixel data for each subpixel in the column drivers 160*a* through 160*h* is then converted into an analog voltage. This is accomplished by loading each subpixel into a digital to analog converter. The load signal 115 from the timing control instructs all of the column drivers to load each subpixel into the digital to analog converter. Thus, each column driver 160*a* through 160*h* requires 384 different digital to analog converters in order to convert each subpixel into a red, green or blue analog signal. Accordingly, in the prior art embodiment illustrated in FIG. 1, each digital to analog converter must be a six bit converter and the conversion of each subpixel from digital pixel data to an analog signal occurs after all the column drivers have been loaded and the timing controller 110 has sent the load signal 115. It is understood that although the embodiment illustrated in FIG. 1 shows a six bit depth per subpixel, the prior art may also typically use an eight bit pixel depth, thereby requiring 384 eight bit digital to analog converters (one for each subpixel).

After the digital pixel data for each subpixel has been converted into an analog signal, each of the analog red, green and blue signals are then passed through a buffer, in order to generate sufficient current levels, and applied to the column electrodes on an entire row basis. Thus, all red, green and blue analog signals for each subpixel in a row are applied to the column electrodes at the same time so the entire row is displayed in synch. The entire process illustrated above is repeated on a row by row basis until the entire image to be displayed has been transferred, converted, and displayed.

FIG. 2 illustrates a functional block diagram of a conventional column driver 160. As shown, the conventional column driver 160 includes a data register 200, for loading the digital pixel data from the parallel data bus line 150, and a shift register 210 for keeping track of the loading process. The conventional column driver 160 also includes a separate hold register 220 for holding the 384 subpixel data once the complete row data for that particular column driver has been loaded from the parallel data bus line 150. In this way, the conventional column driver 160 can continue to sample digital pixel data for a next row in the display while it processes the 384 subpixel data received for the current row.

Digital pixel data is loaded into the data register 200 of the column driver in parallel 36 bits or two pixels at a time. The shift register 210 is preferably a 64 stage shift register. Each time 36 bits or two pixels are loaded into the data register 200 of the column driver, the shift register 210 increments one stage. Accordingly, as the first 36 bits or two pixels are loaded in parallel from the parallel data bus line 150, into the data register 200, the shift register 210 increments one stage. As the next 36 bits or two pixels are loaded in parallel into the data register 200, the shift register 210 increments another stage. When all 128 pixels have been loaded into the data register 200, the shift register 210 increments to a final 64th stage, thereby triggering the column driver 160*a* to send an enable signal 165 to the next column driver 160*b* 420 so that the next column driver 160*b* can begin downloading digital pixel data from the parallel data bus line 150.

Once all 128 pixels have been loaded into the data register 200, the timing controller 110 sends a load signal 115 to the hold register 220, and all 128 pixels are transferred to the hold register 220, in parallel, for holding. In this way, once the last column driver 160*h* has been fully loaded, the first column driver 160*a* can once again begin downloading digital pixel data from the parallel bus line 150 into its data register 200.

A conventional column driver further includes 384 digital to analog converters (one for each subpixel). Once all of the digital pixel data for each subpixel in the complete row has been loaded into all the column drivers 160*a* through 160*h*, each six bit subpixel (red, green and blue) is converted within each column driver 160*a* through 160*h* into an analog red, green or blue signal which is then buffered and driven to the column electrodes of the display. Accordingly, each column driver requires 384 digital to analog converters, one for each subpixel, and the converters may be six bit or eight bit converters (depending upon the bit depth of the particular drive system involved). After all of the digital pixel data in all column drivers have been converted into analog signals, the analog red, green and blue signals are buffered in order to generate sufficient current and driven to the column electrodes of the display.

Typically, one row of data is provided in 16 $\mu$sec one pixel at a time at a pixel rate of 65 MHz or two pixels at a time at a pixel rate of 32.5 MHz. This 16 $\mu$sec is divided between the column drivers since each column driver receives digital pixel data sequentially—i.e. after the previous column driver has received all of its digital pixel data and the enable signal has been activated. Accordingly, as one can see, the amount of time required to transfer the data to each column driver and convert the data into analog voltages is limited. As active matrix displays become larger, the implementation and performance of the drive system becomes increasingly difficult to design. The number of column drivers is increased and the amount of time it takes for data to be loaded into each column driver and converted to analog signals is decreased, such that the drivers must perform faster as the number of pixels or display resolution increases.

Accordingly, what is needed is a more efficient system and method for driving an active matrix liquid crystal display such that as the number of pixels or display resolution increases, the system and method continues to perform efficiently.

SUMMARY OF THE INVENTION

The invention is for an improved display module driving system having six digital to analog converters per column driver instead of 384 digital to analog converters. Moreover, unlike conventional drive systems, the improved display module driving system does not use a parallel data bus line; but, rather transfers data serially to each of the column drivers at the same time. This configuration reduces EMI and current consumption and increases processing time allocated for each of the column drivers to perform the digital to analog conversion.

In one aspect of the invention, the driving system includes a controller which serially provides digital display data to multiple column drivers via dedicated serial bus lines rather than one parallel data bus line. The serial bus lines may be two or three bit lines depending upon the number of bits used per RGB subpixel. By having the digital pixel data transferred serially to each column driver over dedicated serial bus lines, rather than transferring the pixel data in parallel over a single parallel bus line, each column driver can receive and process the digital display data at the same time, thereby allowing each column driver more time in which to process the parallel pixel data.

In a further aspect of the invention, the driving system includes multiple column drivers for driving column electrodes of an active matrix liquid crystal display. Each column driver receives digital pixel data serially over a dedicated bus line and arranges the digital pixel data in parallel. Once the digital pixel data has been arranged into parallel, each subpixel is converted into an analog signal at an earlier stage of the column driver than in the prior art. The analog signals are then sampled and held until all column drivers have converted their digital pixel data. Since the conversion is done at an earlier stage, each column driver only requires six digital to analog converters rather than 384 digital to analog converters.

In a further aspect of the invention, each column decoder comprises an analog sample and hold module which includes six pairs of sample and hold capacitors and two different sets of switches. The analog signals are selectively sampled and used to charge one of the capacitors in each of the six pairs of sample and hold capacitors. Meanwhile, the other capacitor in each of the six pairs of sample and hold capacitors is discharged, with the voltage stored on the capacitor being transferred from the discharging capacitor to a column electrode in order to drive the display. In this way, the sample and hold capacitors alternately store and release the analog voltages which are used to drive the column electrodes of the display, thereby allowing the column decoder to perform at a higher speed.

DETAILED DESCRIPTION OF PREFERRED EMBODIMENT

Figure 1:
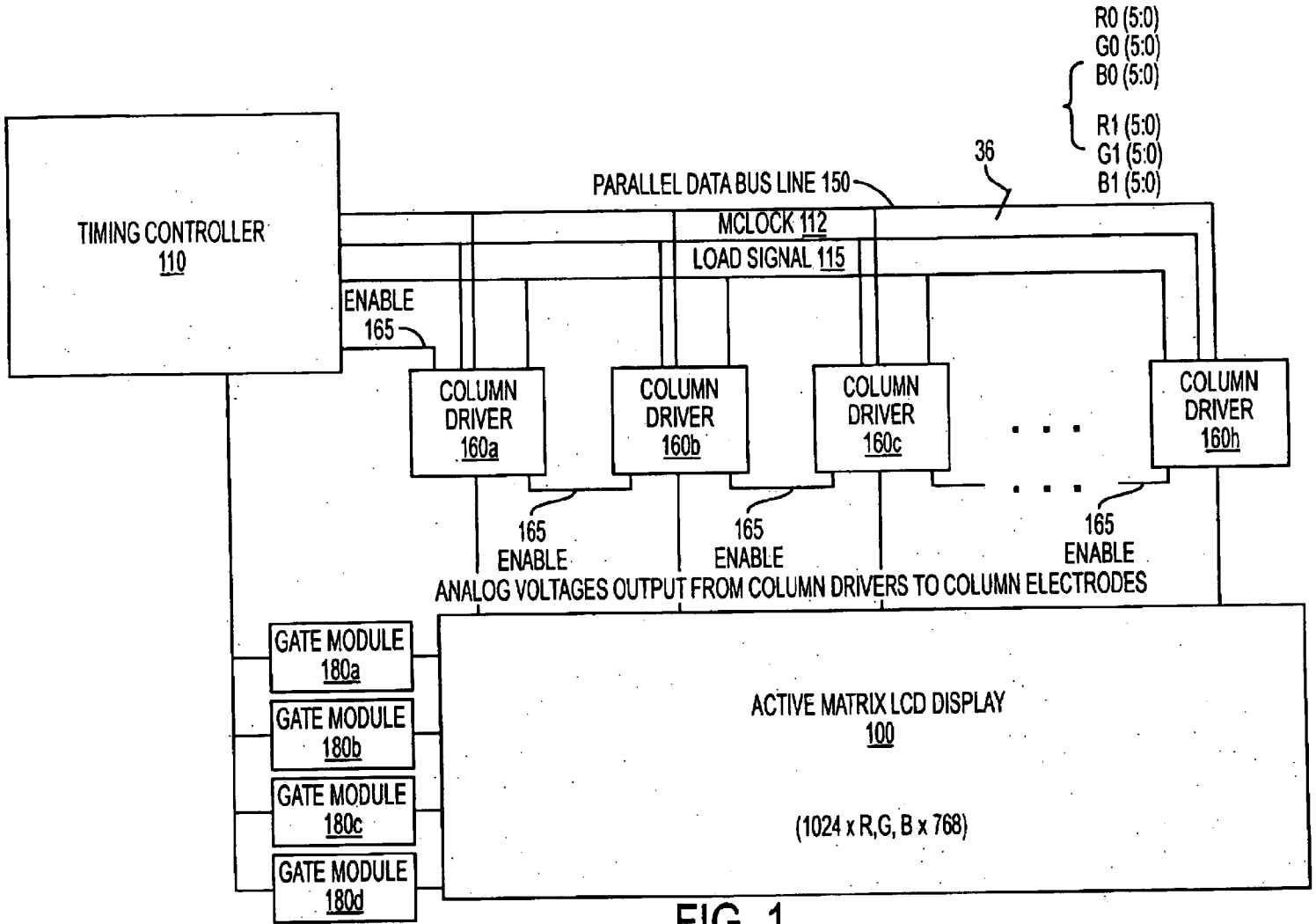
FIG. 1 (PRIOR ART)
FIG. 1 illustrates a conventional prior art active matrix liquid crystal display drive system.
Figure 2:
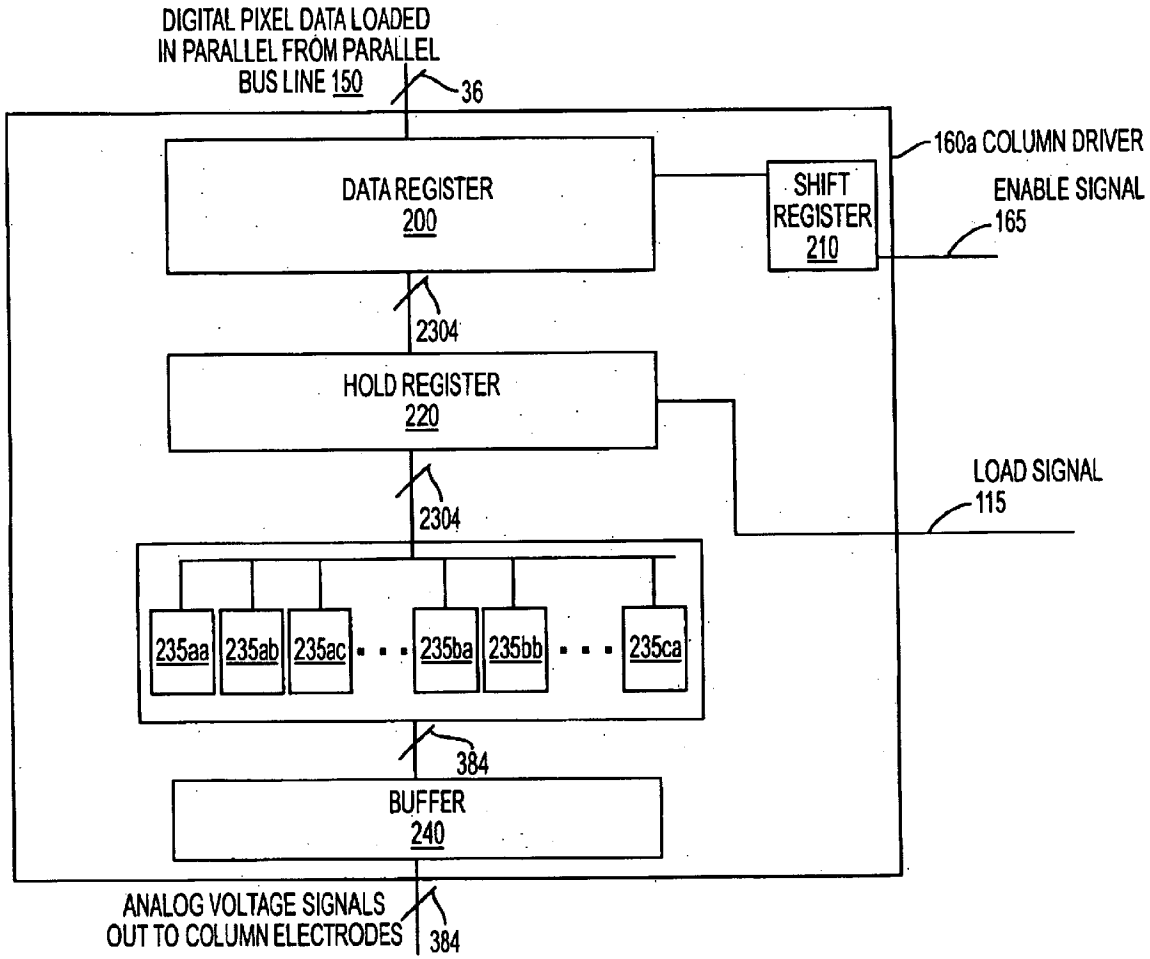
FIG. 2 (PRIOR ART)
FIG. 2 illustrates a functional block diagram of a conventional column driver.
Figure 3:
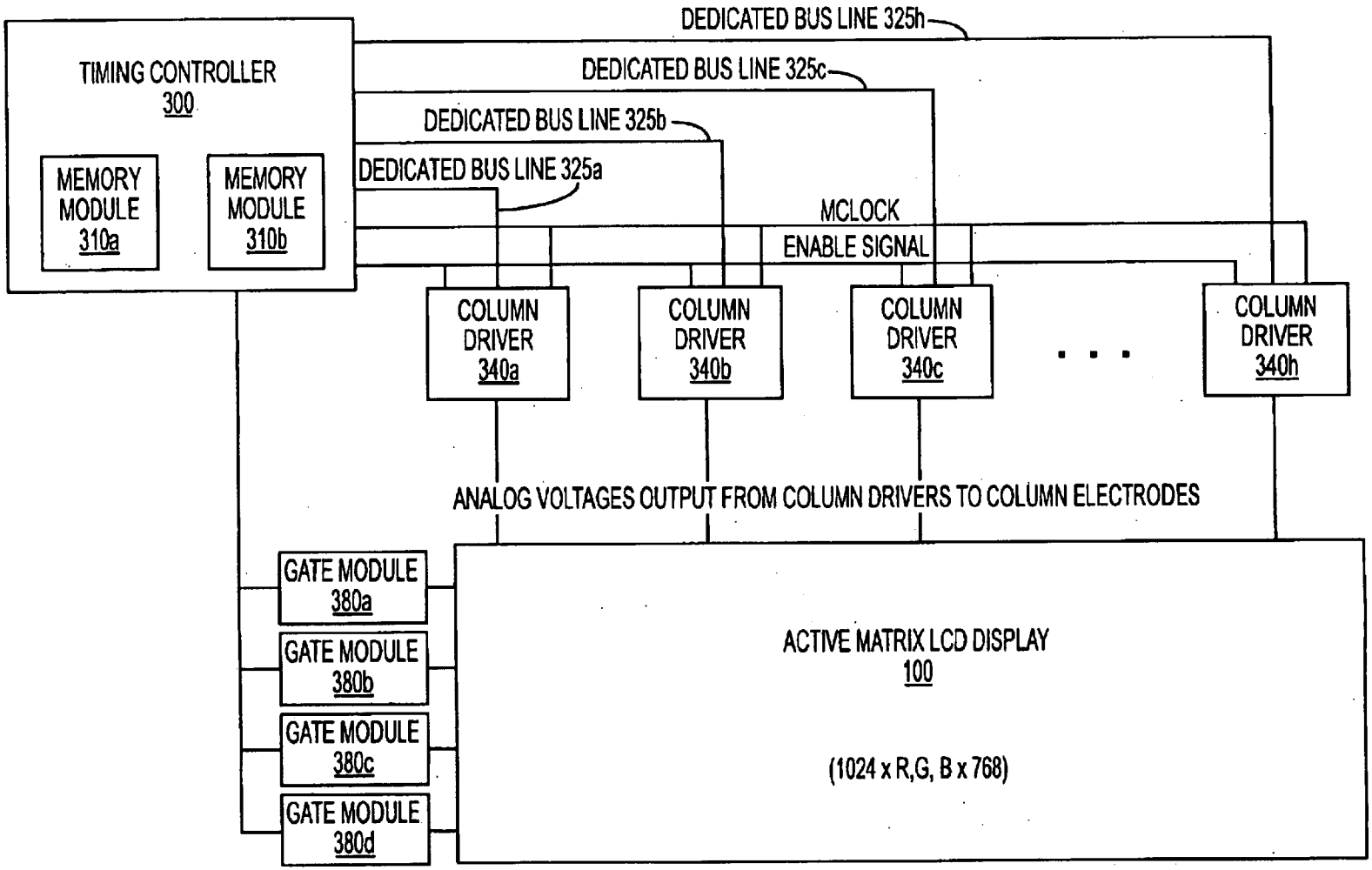
FIG. 3 illustrates a functional block diagram for a display drive system in accordance with the present invention.

FIG. 3 illustrates a display drive system in accordance with the present invention. An active matrix display is driven by gate modules 380*a* through 380*d* and column drivers 340*a* through 340*h*. Due to spatial limitations, FIG. 3 only shows column drivers 340*a*, 340*b*, 340*c* and 340*h*. However, it is understood that in the drive system of the present invention, in order to drive an active matrix display having a resolution of 1024 pixels×768 pixels, eight column drivers are used, with each column driver supporting 384 subpixels or memory cells the rows of the active matrix display.

As shown in FIG. 3, a timing controller 300 is coupled to the eight column drivers 340*a* through 340*h* and four gate modules 380*a* through 380*d*. The gate modules 380*a* through 380*d* provide row voltages to the active matrix display in order to activate the display cells in each row of the display. The timing controller 300 stores digital pixel data for the image to be displayed and provides the digital pixel data to the column drivers 340*a* through 340*h*. The digital data is preferably stored within a pair of memory modules 310*a* and 310*b* within the timing controller 300.

The memory modules 310*a* and 310*b* are preferably each comprised of a matrix of memory cells arranged into rows and columns. Digital pixel data for an image to be displayed on the active matrix display are received by the timing controller 300 from an exterior source, such as a CD-Rom, a hard disk drive, or a modem connected to the intranet/internet. The digital pixel data for the image to be displayed is preferably stored in each of the memory modules 310*a* and 310*b* of the timing controller on a row by row basis as it is received. Preferably, the timing controller stores a first row of digital pixel data in one of the memory modules 310*a* or 310*b*, while a second row of digital pixel data is stored in the other memory module 310*a* or 310*b*. In this way, when the digital pixel data are read from one memory module 310*a* or 310*b*, digital pixel data for a next row in the image to be displayed can be loaded into the other memory module 310*a* or 310*b* such that the two memory modules 310*a* and 310*b* are alternatively read from and written to until all of the digital pixel data for each of the rows of the image to be displayed have been processed and displayed. Alternatively, the timing controller may utilize any other suitable memory device for temporary storage of separate rows of digital pixel data, such that while one row is being stored in the memory device another rows is being read from the memory device and processed for display.

The timing controller 300 provides the digital pixel data to multiple column drivers 340*a* through 340*h* for driving the column electrodes of an active matrix liquid crystal display. Unlike conventional display driving systems, the timing controller 300 of the present invention is coupled to each of the multiple column drivers 340*a* through 340*h* by multiple dedicated bus lines 325*a* through 325*h*, with one dedicated bus line per column driver. Preferably, each dedicated bus line 325*a* through 325*h* is a three bit bus line. Alternatively, each dedicated bus line may be a two bit bus line.

In operation, digital pixel data for an entire row are retrieved by the timing controller 300, from a memory in the timing controller 300, on a parallel basis for each of the column drivers 340*a* through 340*h*. The digital pixel data is then divided into eight parallel segments, with one parallel segment for each column driver 340*a* through 340*h*. The digital pixel data in each parallel segment is then converted into serial and transferred to the column drivers 340*a* through 340*h* through the dedicated bus lines 325*a* through 325*h*. Accordingly, the complete digital pixel data for a single row in the image to be displayed is transferred to each of the column drivers 340*a* through 340*h* concurrently, such that any one column driver receives its individual segment of serial digital pixel data at the same time each of the other column drivers receives their individual segment of serial digital pixel data. Accordingly, each column driver 340*a* through 340*h* is able to begin processing its segment of serial digital pixel data without having to wait for digital pixel data to be transferred to each of the other column drivers. Therefore, unlike conventional column drivers, the column drivers 340*a* through 340*h* of the present invention do not require an enable signal before they are loaded.

More specifically, the digital pixel data for display across a first row of an active matrix liquid crystal display is retrieved from the memory of the timing controller 300 and divided or broken into segments. Preferably, each segment is 128 pixels in length or 384 RGB subpixels. Each segment of digital pixel data is then serially transferred to a corresponding column driver 340*a* through 340*h* over the appropriate corresponding dedicated bus line 325*a* through 325*h*. Thus, digital pixel data from a first segment is serially transferred to column driver 340*a* over dedicated bus line 325*a*; while, at the same time, digital pixel data from a last segment is transferred to column driver 340*h* over dedicated bus line 325*h*. In this way, the digital pixel data is transferred to each column driver serially such that each column driver receives the digital pixel data which corresponds with its segment of the row, without having to wait for the previous column drivers to receive their respective segments.

Figure 4:
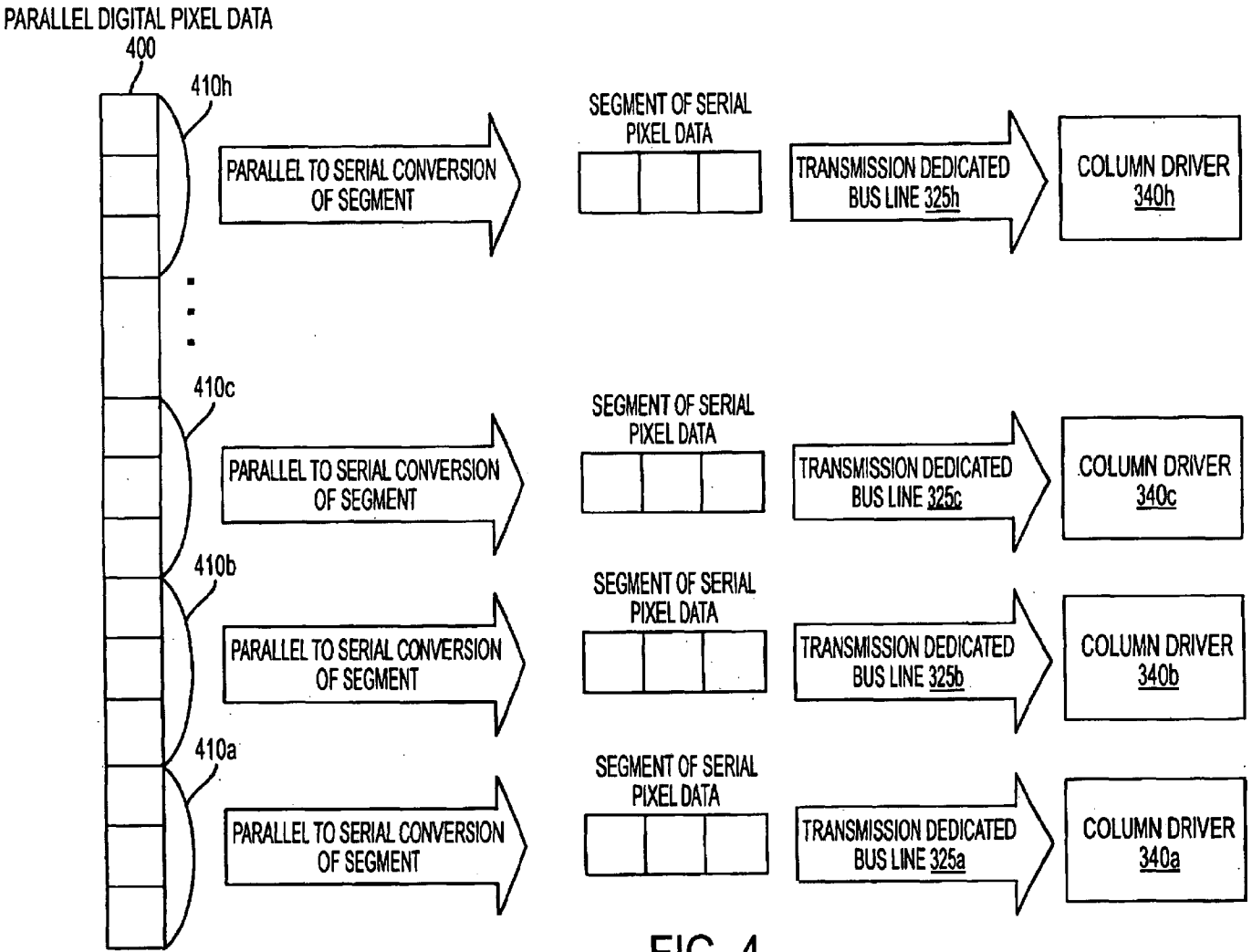
FIG. 4 illustrates the serial transfer of digital pixel data from the timing controller to each of the individual column drivers in the system of the present invention.

FIG. 4 further illustrates the concept of how digital pixel data is transferred from the timing controller 300 to each of the individual column drivers 340*a* through 340*h*. FIG. 4 shows a stream of digital pixel data 400 which represents a row in the active matrix liquid crystal display 100. The complete digital pixel data is actually made up of 1024 pixels which is comprised of 18,432 bits, with each pixel in the row having a red subpixel of six bits in length, a green subpixel of six bits in length, and a blue subpixel of six bits in length. However, for simplicity sake in understanding the basic operations of the present invention, the digital pixel data shown is made up of blocks with each block representing a pixel. The total number of pixels is not the same and is reduced for purposes of illustration.

As shown, in FIG. 4, the complete row of parallel digital pixel data is divided up into eight sections 410*a* through 410*h* (one section for each column driver 340*a* through 340*h*). A first section 410*a* of the complete row of parallel digital pixel data is to be transferred to column driver 340*a*, a second section 410*b* of the complete row of parallel digital pixel data is to be transferred to column driver 340*b*, etc. However, before the sections 410*a* through 410*h* are transferred to their respective column drivers, they are each converted into a segment of serial digital pixel data, one pixel at a time. The process of converting the sections from parallel digital pixel data to serial digital pixel data progresses sequentially through all 128 pixels corresponding with the column driver.

Accordingly, the first section of parallel digital pixel data 410*a* is converted into a segment of serial digital pixel data one pixel at a time until all 28 pixels have been converted. The segment of serial pixel data is then transferred serially over the dedicated bus line 325*a* to the first column driver 340*a*. For a six bit pixel depth design (wherein each subpixel is represented by six bits), the dedicated bus line 325*a* is preferably two bits wide, such that two pixels may be serially transmitted over the dedicated bus line 325 two bits at a time (one bit over each bitline) for each MCLOCK pulse. Accordingly, all bits for the red subpixels, the green subpixels and the blue subpixels in two pixels are serially transmitted over the two bit lines within 18 MCLOCK pulses. The 128 pixels of data sent to a single column driver will require 1152 clock cycles at one bit per line per clock cycle for a clock rate of 65 MHz.

In an alternative embodiment for an eight bit pixel depth design (wherein each subpixel is represented by eight bits), each dedicated bus line is three bit lines wide, such that three bits are transmitted at the same time (one over each bit line) for each MCLOCK pulse. Accordingly, in this alternative embodiment, all bits for the red subpixel, the green subpixel and the blue subpixel are serially transmitted over the three bit lines within 16 MCLOCK pulses. The 128 pixels of data sent to a single column driver will require 1024 clock cycles at one bit per line per clock cycle for a clock rate of 65 MHz. Alternately, the digital pixel data may be sent at half the clock rate and sampled on both rising and falling edges of the clock pulse.

A second section of parallel digital pixel data 410*b* is converted into a segment of serial digital pixel data one pixel at time until all 128 pixels have been converted. The segment of serial pixel data is then transferred over dedicated bus line 325*b* to the second column driver 340*b*, preferably two pixels at a time. Once again, in the preferred embodiment for a six bit pixel depth (wherein each subpixel is represented by six bits), the dedicated bus line 325*b* is preferably two bits wide, such that all bits for the red subpixels, the green subpixels and the blue subpixels in two pixels are serially transmitted over the two bit lines within 18 MCLOCK pulses.

The process is the same for all eight sections 410*a* through 410*h* of the complete row of parallel digital pixel data. All eight sections 410*a* through 410*h* are converted into segments of serial digital pixel data, which are then transferred to the appropriate column driver 340*a* through 340*h*, over a corresponding dedicated bus line 325*a* through 325*h*. It is understood that alternative embodiments may exist in the transfer of the segments of serial digital pixel data from the timing controller 300 to the column drivers 340*a* through 340*h* so long as the parallel digital pixel data is divided up into sections, the sections are arranged in serial segments of digital pixel data, and the segments of digital pixel data are transmitted over the dedicated bus lines 325*a* through 325*h*.

Figure 5:
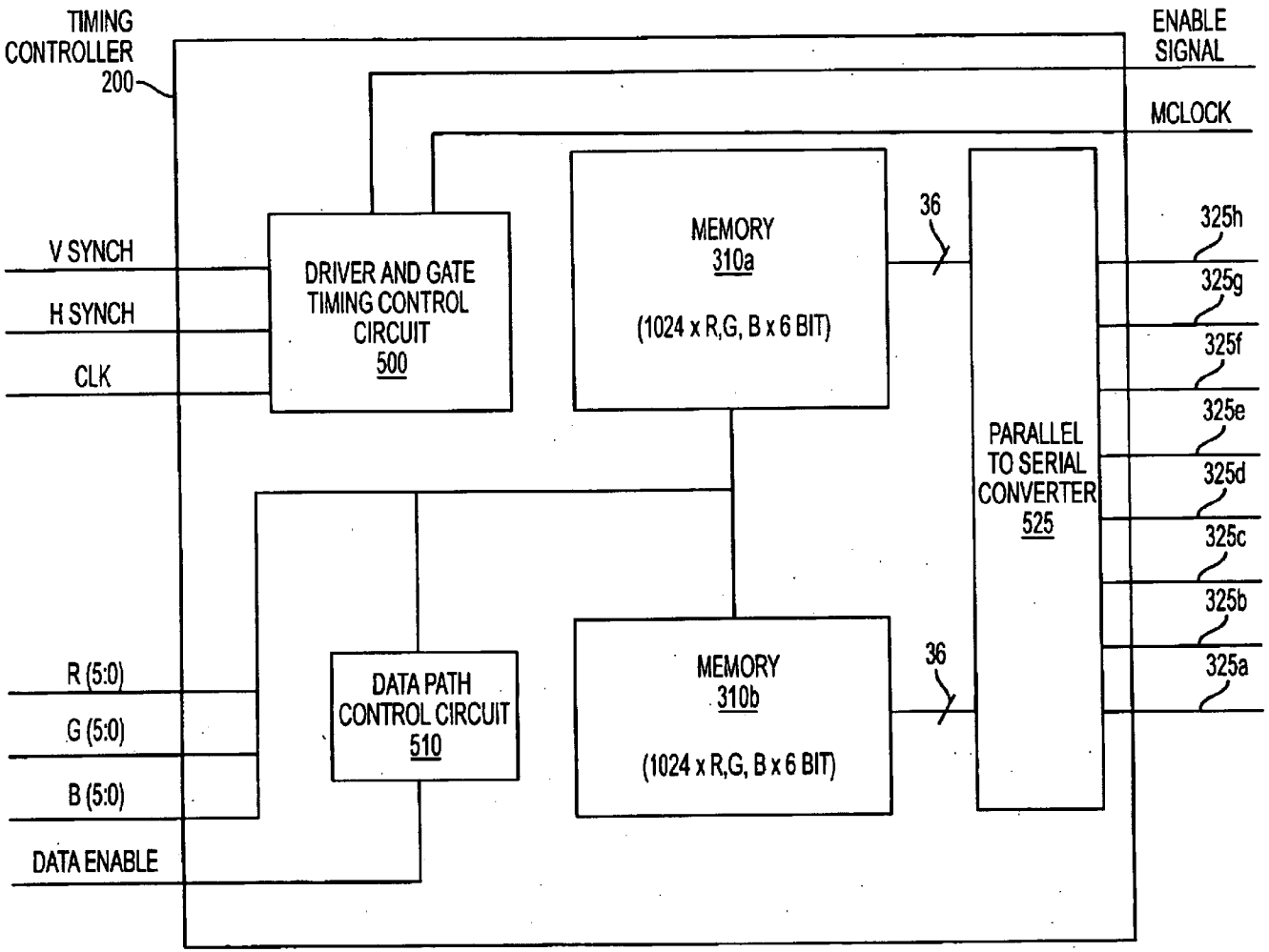
FIG. 5 illustrates a functional block diagram for a preferred embodiment of a controller used within a display drive system in accordance with the present invention.

FIG. 5 illustrates a preferred embodiment for a timing controller 200 used within a display drive system in accordance with the present invention. As shown the controller 200 includes a driver and gate timing control circuit 500, a data path control circuit 510, two separate memory modules 520*a* and 520*b* and a parallel to serial converter 525. In a preferred embodiment, the two separate memory modules are able to hold 1024 digital pixel data having six bit red, green and blue subpixels, such that each memory can store 18432 bits of digital pixel data (1024 pixels×3 subpixels×6 bits per subpixel). In an alternative embodiment, each of the two separate memory modules are able to hold 1024 pixels of digital pixel data having eight bit red, green and blue subpixels, such that each memory can store 24576 bits of digital data (1024 pixels×3 subpixels×8 bits per subpixel). Each memory is preferably matrix of memory cells arranged in rows and columns. Alternatively, any other appropriate temporary data storage means may be used as memory.

Digital pixel data is read in through the six bit RGB signal lines from an external source, such as a CD-Rom and stored in the two separate memory modules 525*a* and 525*b* on a row-by-row basis. Accordingly, digital pixel data for a first row of a 1024 pixel image is stored in the first memory. As that data is read out into the column drivers, digital pixel data for a second row of a 1024 pixel image is stored in the second memory. When all of the data from the first memory has been transferred to the column drivers, the second memory begins transferring the digital pixel data for the second row out to the column decoders while the first memory stores the data for the third row of the image. This way, while one memory is reading out data to the column drivers, the other memory is receiving in data from the external source, such as a CD-Rom. The data path control circuit 510 controls which memory receives the input digital image data from the external source and which memory reads out digital pixel data to the column drivers.

In the present invention, the controller 200 includes a parallel so serial data converter 525. Unlike convention controllers, the digital pixel data is provided serially to each of the column drivers 340*a* through 340*h*, over dedicated bus lines 325*a* through 325*h* rather than a parallel data bus line. The parallel to serial data converter 525 retrieves data from the memory in parallel and divides the data into segments, wherein the number of segments is equal to the number of column drivers. Each segment is then converted into serial data and transferred to the appropriate column driver via the corresponding dedicated bus line.

Figure 6:
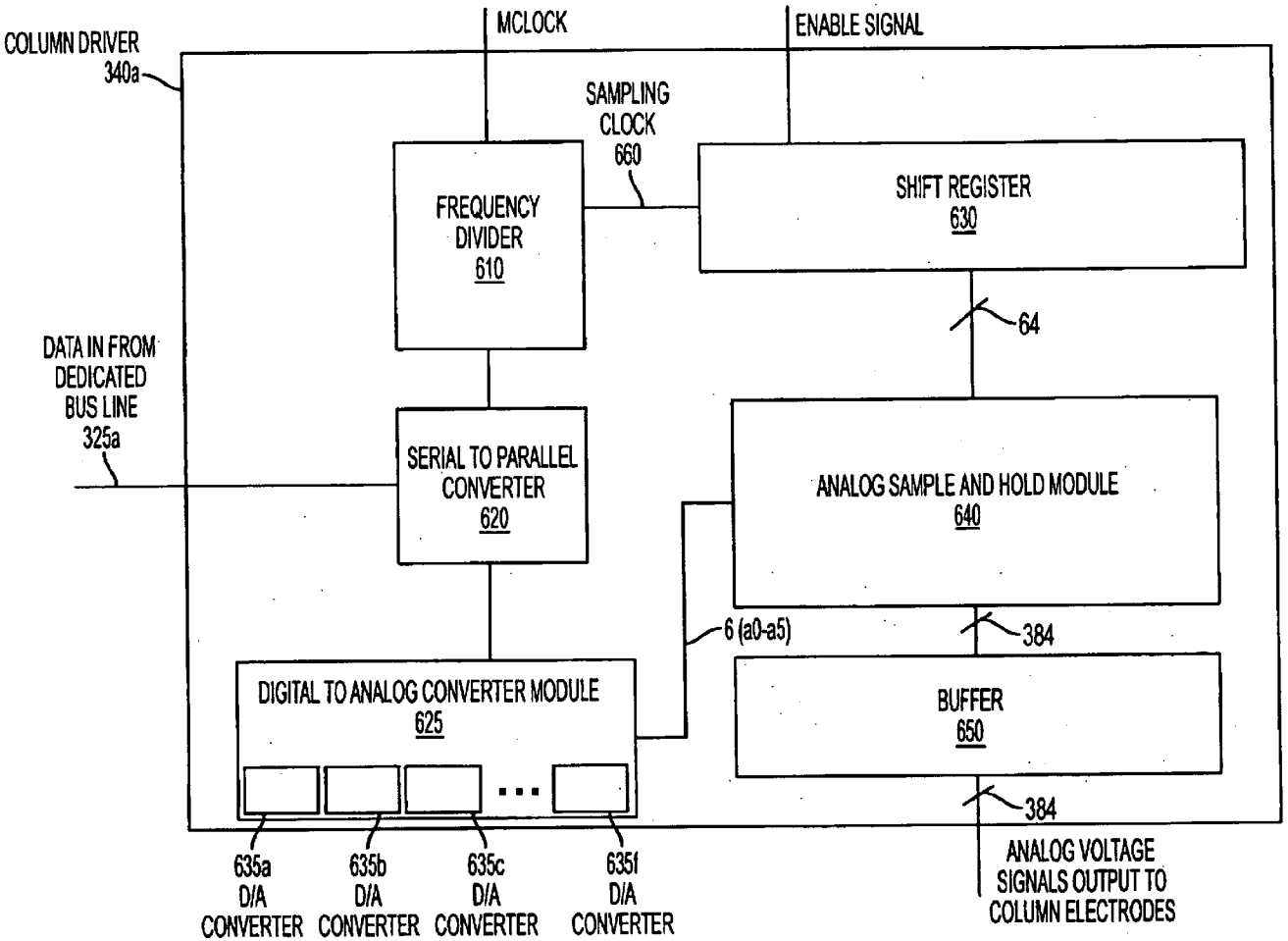
FIG. 6 illustrates a functional block diagram for a preferred embodiment of a column driver used within a display drive system in accordance with the present invention.

FIG. 6 illustrates a preferred embodiment for a column driver 340*a* used within a display drive system in accordance with the present invention. As shown, the column driver 340*a* includes a frequency divider 610 which is coupled to a shift register 630, which is further coupled to an analog sample and hold module 640. The column driver 340*a* further includes a serial to parallel converter 620 which is coupled between the frequency divider 610 and a digital to analog converter module 625. The digital to analog converter module 625 is comprised of six individual digital to analog converters 635*a* through 635*f*. The digital to analog converter module 625 is also coupled to the analog sample and hold module 640. Finally, the column driver includes a buffer 650 which is coupled to the analog sample and hold module.

In operation, the column driver 340*a* receives the segments of serial digital pixel data at the serial to parallel converter 620 and converts the digital pixel data from serial format into parallel, such that each subpixel (red, green and blue) is rearranged into six parallel bits. Preferably, the parallel digital pixel data is then fed into the digital to analog converter module 625 two pixels at a time over a thirty six bit bus line, such that each of the six digital to analog converters 635*a* through 635*f* receives one six bit subpixel.

As explained above, the digital to analog converter module 625 is preferably comprised of six individual digital to analog converters 635*a* through 635*f*, with each individual digital to analog converter 635*a* through 635*f* configured for converting a six bit subpixel from digital pixel data into an analog signal. The digital to analog converter module 625 preferably has at least sixteen different reference voltages. Therefore, each six bit subpixel is converted into one of the at least sixteen different reference voltages. Accordingly, there are two pixels input to the digital to analog converter 625 and six analog signals are output, one analog signal for each six bit red, green and blue subpixel in the two pixels.

In an alternative embodiment, the digital pixel data may be transferred to the digital to analog converter module 625 more than two pixels at a time. In this alternative embodiment, the digital to analog converter module 625 would require more than six individual digital to analog converters 635*a* through 635*f* For example, the digital to analog converter 625 may receive the digital pixel data four pixels at a time over a 72 bitline bus. However, unlike the prior art, in the present invention it is not required that all subpixels be converted at the same time and, accordingly, 384 digital to analog converters are not needed. Moreover, it is understood that the number of references voltages may be varied and alternate embodiments having more or less reference voltages are intended to be covered herein.

Preferably, six analog signals are output from the digital to analog converter module 625 after every two pixels are converted, one analog signal for each digital to analog converter 635*a* through 635*h*. The analog signals are output over a six line bus which is sampled by the sample and hold module 640. The frequency divider 610 and the shift register 630 control the sampling rate of the sample and hold module 640. Preferably, the shift register 630 is preferably a 64 stage shift register, wherein six analog signals (one for each subpixel in two pixels) are sampled at each stage. Accordingly, as the digital to analog converter module 625 converts the digital pixel data, two pixels at a time, it outputs six analog signals which are then sampled as the shift register cycles through each of its 64 stages. Therefore, by the time the shift register 630 has cycled through to its sixty-fourth stage, all 384 different analog signals (one for each subpixel) have been sampled. In this way, after cycling through all 64 stages, three different red, green and blue analog signals for each of the 128 pixels have been completely sampled by each column driver. The sample and hold circuit preferably uses a dual capacitor arrangement such that the analog signals for each of the two pixels can be sampled and stored in each of the capacitors alternatively.

Figure 7:
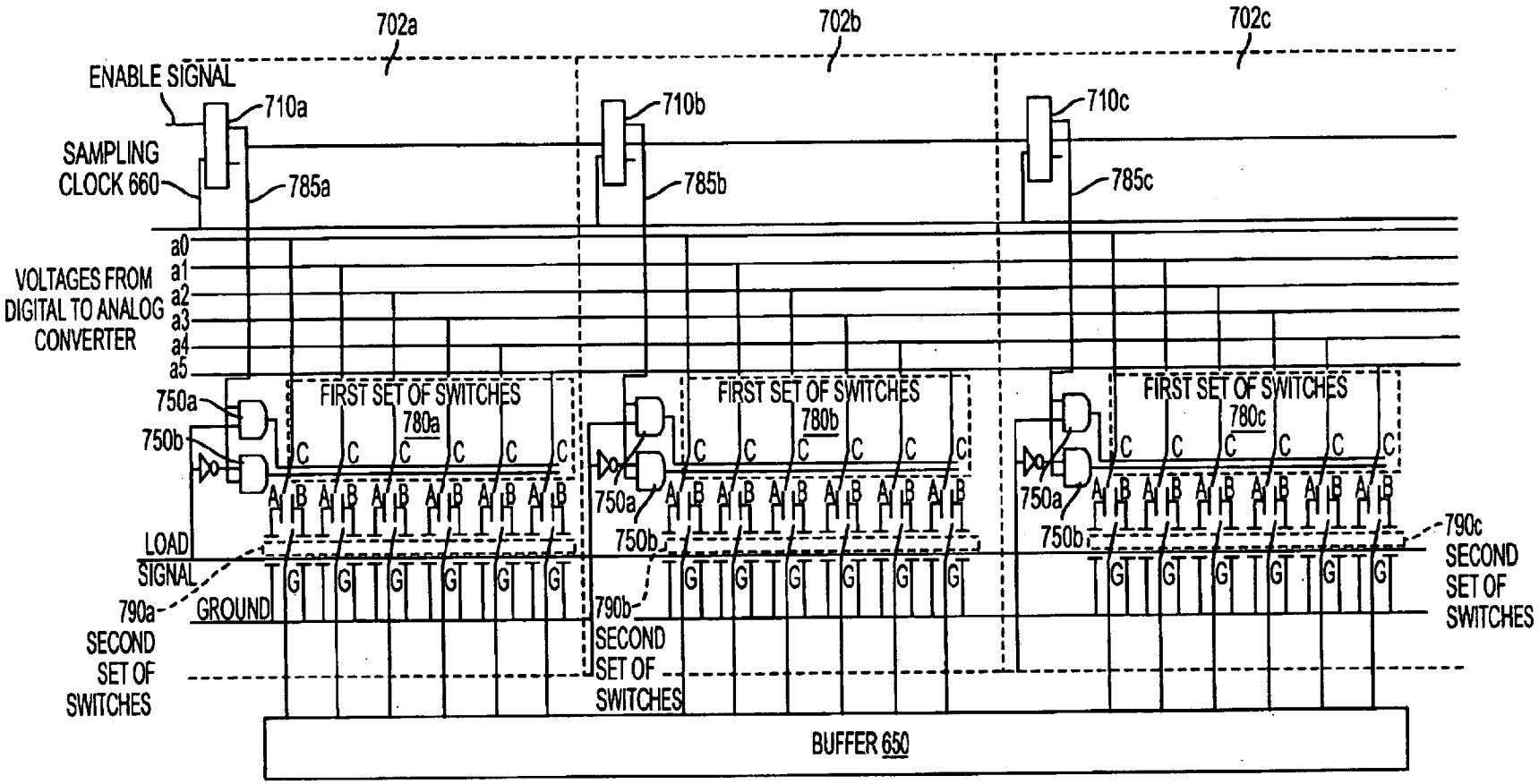
FIG. 7 illustrates a schematic diagram showing the operations of a preferred embodiment for a column driver used with a display driver system in accordance with the present invention.

FIG. 7 illustrates a schematic diagram showing the operations of a preferred embodiment for a column driver used with a display driver system in accordance with the present invention. Each column driver includes 64 stages, wherein there are six analog signals output from each stage. For simplicity of understanding and due to spatial constraints, only the first three stages 702*a* through 702*c* have been shown in FIG. 7. However, as is shown in the diagram of FIG. 7, and explained further below, the stages 702*b* and 702*c* are identical in structure and performance. Moreover, the other 61 stages which are not depicted in FIG. 7 are also share the same structure and performance as those shown in stages 702*b* and 702*c* of FIG. 7. Accordingly, it is not necessary to show all 64 stages in order to understand the operations of a column driver designed in accordance with the present invention.

Referring to FIG. 7, each stage 702*a* through 702*c* contains a flip flop 710 having a data input D and two outputs Q and QN. Preferably, the flip flop 710 is used as a latch having a clock signal input which activates the latch whenever the clock signal is active. The clock signal is actually the sampling clock signal 660 which is output from the frequency divider 610 in the column driver, as shown in FIG. 6. In the preferred embodiment, each flip flop 710 is activated when the sampling clock signal 660 transitions from low to high. The flip flops 710 are each used to activate their corresponding stage 702*a* through 702*c*, such that the first flip flop 710*a* activates stage 702*a*, the second flip flop 710*b* activates stage 702*b*, and so on. Operations of the flip flops 710 are described in further detail herein.

Each stage further contains a first set of six switches 780 (indicated as 780*a* through 780*c* and surrounded by broken lines in FIG. 7) and six pairs of analog sample and hold capacitors. The six pairs of analog sample and hold capacitors are each comprised of a first capacitor and a second capacitor, with the anodes of the first capacitor in each pair being coupled to a respective switch terminal A, and the anodes of the second capacitor in each pair being coupled to a respective switch terminal B. The cathodes of both capacitors in each pair of the six pairs of analog sample and hold capacitors are coupled to a ground signal.

The flips flops 710 are all coupled to the sampling clock signal 660 which is output from the frequency divider 610 (FIG. 6). The data input D to the first flip flop 710*a* in each column driver is coupled to the enable signal from the timing controller 200 (FIG. 5). The data input D of each subsequent flip flop in the other 63 stages is coupled to the output Q from the previous flip-flop. This configuration embodies the shift register 630 of the column driver.

In referring to FIG. 7, it should be readily understood how the shift register 630 operates and cycles through 64 stages. When the enable signal and the sampling clock signal are both active, the first stage flip flop 710*a* latches the enable signal through to its output Q. Since the output Q from the first stage flip flop 710*a* is coupled to the data input D of the second stage flip flop 710*b*, the next time the sampling clock signal and the enable signal are both active, the second stage flip flop 710*b* latches the enable signal through to its output Q. Once again, since the output Q from the second stage flip flop 710*b* is coupled to the data input D of the third stage flip flop 710*c*, the next time the sampling clock and the enable signal are both active, the enable signal is latched through the third stage flip flop to its output Q. This process repeats through 64 stages until the enable signal has been latched through all 64 flip flops.

The outputs Q from each of the 64 flip flops are also coupled to first inputs A of a pair of AND gates 750*a* and 750*b*. The inputs B of both AND gates 750*a* and 750*b* are coupled to a load signal, with one of the inputs B on one of the AND gates 750*b* being inverted. It is understood in referring to FIG. 7 that this configuration ensures that the outputs from the AND gates 750*a* and 750*b* alternate, such that when the output from one AND gate 750*a* is high, the output from the other AND gate 750*b* is low. The outputs from both AND gates 750*a* and 750*b* are coupled to each of the six switches in the first set of switches 780*a* through 780*c*, and are used to alternately activate the switches. For example, when the output from one AND gate 750*a* goes high, the switches are activated to a first position and when the output from the other AND gate 750*b* goes high, the switches are activated to a second position, thereby causing all six switches in the first set of switches 780*a* through 780*c* to alternate back and forth between first and second positions as the outputs from the two AND gates 750*a* and 750*b* alternate.

Figure 8:
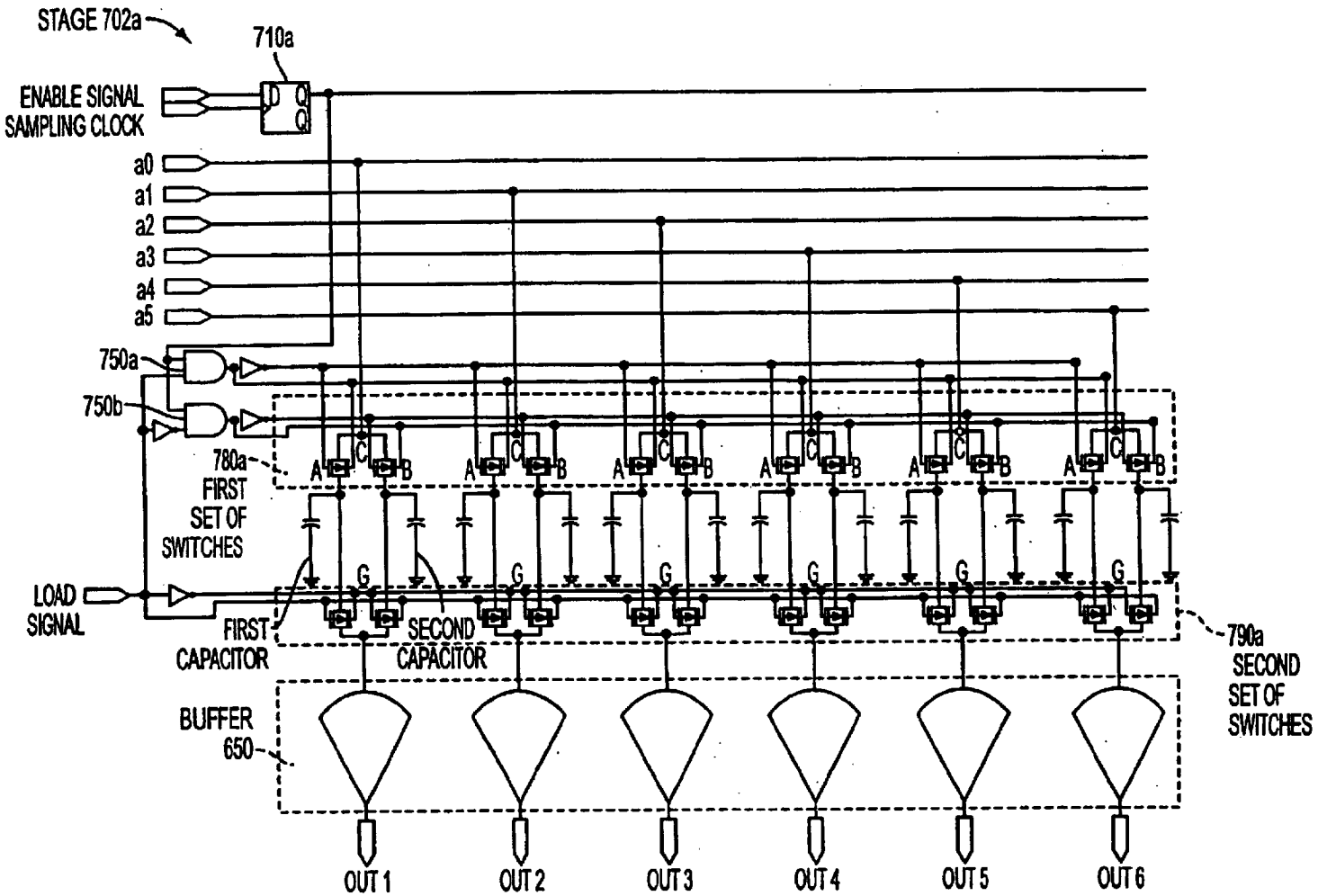
FIG. 8 is a schematic of an exemplary embodiment for a stage.

FIG. 8 shows a close-up view of the first stage 702*a* and further illustrates the operations of the first set of switches 780*a* and the second set of switches 790*a*. It is understood that the first set of switches 780*a* and the second set of switches 790*a* are identical in configuration in each stage, accordingly, the switches operate the same way in each stage. It is further understood that the first set of switches 780*a* in each stage only operate when the output Q from the flip flop is valid for that stage.

As shown in FIG. 8, each stage contains six switches in a first set of switches 780*a* and six switches in a second set of switches. An end terminal C of each switch in the first set of switches 780*a* is coupled to one of six analog signal lines (a0 through a5) which are output from the digital to analog converter 625 (FIG. 6). The analog signals (a0 through a5) represent the analog voltage for each of the subpixels in two separate pixels. Each switch in the first set of switches 780*a* also has a first terminal A and a second terminal B such that when the switch is in a first position, the end terminal C is couple to the first terminal A, and when the switch is a second position, the end terminal C is coupled to the second terminal B. The first terminal A is coupled to an anode of a first capacitor in a corresponding pair of capacitors from the six pairs of capacitors. The terminal B of each switch is coupled to the anode of the second capacitor in the corresponding pair of capacitors from the six pairs of capacitors.

The first set of switches 780*a* are used to couple one of the analog signal lines (a0 through a5) to one of the capacitors in a corresponding capacitor pair from the six pairs of capacitors, in order to store the analog voltage level from the analog signal line (a0 through a5) for that subpixel onto one of the capacitors. Voltages are alternately stored for each subsequent row, such that when each switch in the first set of switches 780*a* is in the first position, the voltage level for the corresponding subpixels in a particular row are stored on the first capacitors in each of the six capacitor pairs and when each switch in the first set of switches 780*a* is in the second position, the voltage level for the corresponding subpixels in a subsequent row are each stored on the second capacitors in the six capacitor pairs.

Further, as shown in FIG. 8, a second set of six switches 790*a* are present in each of the 64 stages and are used to alternately transfer the voltages out from the sample and hold capacitor pairs one row at a time. The voltages stored on each of the capacitors in the six capacitor pairs are alternately transferred through the outputs of the analog sample and hold module 640 to the buffer 650. Each switch in the second set of six switches 790*a* is coupled to the load signal, which activates the switch. The load signal alternates polarity as each new row of digital pixel data is to be displayed in order to trigger operation of the six switches in the second set of switches 790*a*. Again, each switch in the second set of switches 790*a* alternates between switch terminals A and B. Additionally, each switch in the second set of switches 790*a* includes an end terminal G which is coupled to one of the 384 outputs of the analog sample and hold module 640. Each stage outputs 6 analog voltages to the column electrodes of the display. There are 64 stages and, accordingly, there are 384 output signals.

In operation, the second set of switches 790*a* are arranged to switch in the opposite direction from the first set of switches 780*a*, such that when each switch in the second set of switches 790*a* is in a first position, the switch terminal B is coupled to the end terminal G and when each switch is in a second position, the switch terminal A is coupled to the end terminal G. The second set of switches 790*a* through 790*c* are alternately switched back and forth between terminals A and B in order to alternately transfer the voltages stored on each of the capacitors out to the column electrodes on a row by row basis.

Accordingly, to summarize the operation of the first and second sets of switches 780*a* and 790*a*, when each stage is activated by the Q output from its corresponding flip flop 710, each switch in the first set of switches 780*a* transitions from one position to another in order to alternately store the analog signals (a0 through a5) on each of the capacitors in the six capacitor pairs. Accordingly, if each switch in the first set of switches 780*a* transitions to a first position, the first capacitor in each capacitor pair is connected to one of the analog voltage signal lines (a0 through a5) through terminal C such that the corresponding voltage is then stored on the first capacitor through switch terminals C and A. At the same time, each switch in the second set of switches 790*a* also transitions in order to alternately transfer the stored voltages out to a buffer 650 in order to drive the column electrodes. Therefore, using the same example provided earlier in describing the operation of the first set of switches 780*a*, when the first set of switches 780*a* are each in a first position, each switch in the second set of switches 790*a* is also in a first position such that the second capacitor in each capacitor pair is connected to the buffer 650 through terminal G such that the voltage which was previously stored on that second capacitor is driven through switch terminals B and G to the buffer. Therefore, the analog voltages from the voltage signal lines (a0 through a5) are alternately stored and transferred, such that while one capacitor in the pair is storing the appropriate voltage level for the subpixel in a subsequent or next row, the other is providing a previously stored voltage level for the subpixel in the current row to the buffer in order to drive the column electrodes.

Finally, the 384 outputs from each of the six capacitor pairs in all 64 stages of the analog sample and hold module 640 are each coupled to an individual buffer within the buffer module 650. The individual buffers receive the analog voltage levels from the capacitors through the second set of switches and generate sufficient current levels in order to drive the column electrodes of the display.

While the present invention has been described in terms of six and eight bit pixel depth, it is understood that the invention is not intended to be limited to the same and may be utilized in alternate designs having greater or smaller pixel depth. Moreover, although the invention has been described in terms of driving a display having a resolution of 1024 pixels×768 pixels, it is understood that the invention is not intended to be limited to such a display resolution; but, rather, is intended for future implementation in larger scale displays. In such a case, additional column drivers designed in conformity with the specifics details and embodiments set forth herein may be utilized. Because all column drivers receive their segment of the digital pixel data for the row to be displayed at the same time, the number of column drivers and the size of the display may be increased more easily than that which was available in prior art drive system designs.

What is claimed is:

1. A display drive system comprising:

a plurality of column drivers;

a plurality of dedicated serial buses, each dedicated serial bus coupled to one of the column drivers; and a timing controller coupled to each column driver in the plurality of column drivers by the plurality of dedicated serial buses, for providing a row of digital pixel data to the plurality of column drivers, wherein the digital pixel data is divided into segments and each segment is serially provided to one of the column drivers in the plurality of column drivers via the dedicated serial bus coupled between the timing controller and the column driver such that the entire row of digital pixel data is provided to the plurality of column drivers at the same time; wherein each segment contains two adjacent pixels of data.

2. The display drive system of claim 1, wherein each column driver in the plurality of column drivers comprises a serial to parallel converter which receives the serially provided segment of digital pixel data and rearranges the segment into parallel pixel data until all of the pixels in the segment have been received and arranged into parallel.

3. The display drive system of claim 2, wherein each column driver in the plurality of column drivers further comprises a digital to analog converter module coupled to the serial to parallel converter, for converting each pixel in the parallel pixel data into analog red, green and blue signals.

4. The display drive system of claim 3 wherein the digital to analog converter module converters the parallel pixel data into analog red, green and blue signals two pixels at a time, such that there are six digital to analog converters within the digital to analog converter module, with a first digital to analog converter generating an analog red signal for a first pixel, a second digital to analog converter generating an analog green signal for the first pixel, a third digital to analog converter generating an analog blue signal for the first pixel, a fourth digital to analog converter generating an analog red signal for a second pixel, a first digital to analog converter generating an analog green signal for the second pixel, and a sixth digital to analog converter generating an analog blue signal for the second pixel.

5. The display drive system of claim 3, wherein each column driver in the plurality of column drivers further comprises an analog sample and hold module coupled to the digital to analog converter module for sampling the analog red, green and blue signals for each pixel in the parallel pixel data, one group of pixels at a time.

6. The display driver system of claim 5, wherein the analog sample and hold module samples the analog red, green and blue signals of each pixel in the parallel pixel data, two pixels at a time such that a total of six analog signals are sampled at the same time.

7. The display driver system of claim 5, wherein the analog sample and hold module includes a plurality of first capacitors, one first capacitor for sampling each red, green and blue signal for each pixel in the group of pixels.

8. The display driver system of claim 5, wherein the analog sample and hold circuit includes a plurality of first and second capacitor pairs, each first capacitor for sampling the red green and blue signal for each pixel in the group of pixels from parallel pixel data for a first display row, each second capacitor for sampling the analog red, green and blue signals for each pixel in the group of pixels from parallel pixel data in a next display row.

9. The display driver system of claim 8, with each first capacitor providing the sampled analog red, green and blue signals to a plurality of column electrodes while each second capacitor samples the analog red, green and blue signals for each pixel in the group of pixels from parallel pixel data in the next display row.

10. A system for driving a display comprising:

a plurality of separate bus lines;

a timing controller coupled to each of the plurality of separate bus lines, the timing controller for receiving digital pixel data, dividing the digital pixel data into a plurality of segments of digital pixel data and serially providing the plurality of segments to a plurality of column drivers simultaneously; wherein each segment contains two adjacent pixels of data and a plurality of column drivers, each column driver coupled to the timing controller via one of the separate bus lines, wherein each column driver receives a particular segment in the plurality of segments via the separate bus line, and further wherein each column driver switches the serially provided segment of digital pixel data into parallel digital pixel data, converts the parallel digital pixel data into analog signals, and provides the analog signals to a plurality of column electrodes for driving the display.

11. The system of claim 10, wherein the timing controller comprises:

a pair of first and second memory modules for receiving and storing the digital pixel data, wherein a first row of digital pixel data is stored in the first memory module and a second row of digital pixel data is stored the second memory module; a data path control circuit coupled to the pair of first and second memory modules for routing the first row of digital pixel data to the first memory module and routing the second row of digital pixel data to the second memory module; and a parallel to serial converter coupled to the pair of first and second memory modules for retrieving the first row of digital pixel data from the first memory module in a parallel format, dividing the digital pixel data into a plurality of segments, converting each segment from parallel format into serial format, and providing each segment in the plurality of segments to a corresponding column driver in the plurality of column drivers via the separate bus line.

12. The system of claim 11, wherein an enable signal is coupled between the timing controller and each column driver in the plurality of column drivers and is used to activate each column driver, thereby allowing the plurality of column drivers to receive their respective segments at the same time.

13. The system of claim 10, wherein each column driver in the plurality of column drivers comprises:

a serial to parallel converter for receiving the segment of serially formatted digital pixel data over the separate bus line and converting the segment into a parallel format one pixel at a time;

a digital to analog converter coupled to the serial to parallel converter for converting each pixel in the parallel formatted segment of digital pixel data into analog red, green and blue signals;

an analog sample and hold module coupled between the digital to analog converter and the plurality of column electrodes for sampling the analog red, green and blue signals of each pixel, storing the sampled analog red, green and blue signals, and releasing the samples of the analog red, green and blue signals to the plurality of column electrodes for driving the display.

14. The system of claim 13 wherein the digital to analog converter module converters each pixel in the parallel formatted segment of digital pixel data into analog red, green and blue signals two pixels at a time, such that there are at least six digital to analog converters within the digital to analog converter module, with a first digital to analog converter generating an analog red signal for a first pixel, a second digital to analog converter generating an analog green signal for the first pixel, a third digital to analog converter generating an analog blue signal for the first pixel, a fourth digital to analog converter generating an analog red signal for a second pixel, a fifth digital to analog converter generating an analog green signal for the second pixel, and a sixth digital to analog converter generating an analog blue signal for the second pixel.

15. The system of claim 13, wherein the analog sample and hold module samplers the analog red, green and blue signals of each pixel, two pixels at a time such that a total of six analog signals are sampled at the same time.

16. The system of claim 13, wherein the analog sample and hold module includes a plurality of sample and bold capacitor pairs having a first capacitor and a second capacitor, and farther wherein the first capacitor and the second capacitor in each analog sample and hold module alternately store and release the samples of the analog red, green and blue signals.

17. A timing controller for controlling a plurality of column drivers through a plurality of separate bus lines, each column driver coupled to the timing controller via a corresponding separate bus line of the plurality of separate bus lines, in order to drive a display, the timing controller comprising:

a pair of first and second memory modules for receiving and storing digital pixel data, wherein a first row of digital pixel data is stored in the first memory module and a second row of digital pixel data is stored in the second memory module;

a parallel to serial converter for retrieving the first row of digital pixel data from the first memory module in a parallel format, dividing the digital pixel data into segments, wherein each segment is two adjacent pixels of data, converting each segment from parallel format into serial format, and simultaneously providing each segment of the serially formatted first row of digital pixel data to a corresponding column driver in the plurality of column drivers via the corresponding separate bus line.

18. A column driver for driving a plurality of column electrodes of a display, comprising:

a serial to parallel converter for serially receiving digital pixel data representing a segment of a display row and converting the digital pixel data into a parallel format; a digital to analog converter coupled to the serial to parallel converter for receiving the parallel formatted digital pixel data and converting the parallel formatted digital pixel data into analog signals; an analog sample and hold circuit for sampling the analog signals, storing the samples and providing the samples of the analog signals to a plurality of column electrodes for driving the display wherein the analog sample and hold circuit includes a plurality of capacitor pairs having a first capacitor and a second capacitor such that each capacitor may alternately store the analog signal samples and provide the samples to the column electrodes.

19. A method for driving a display comprising the steps of receiving a current row of digital pixel data and storing the current row of digital pixel data in a first memory module;

retrieving the current row of digital pixel data in parallel format from the first memory module, dividing the current row of digital pixel data into a number of current row segments, converting each current row segment into a current row serial data stream; and providing each current row serial data stream to a corresponding column driver in a plurality of column drivers, wherein each current row serial data stream is provided to a corresponding column driver via a dedicated bus line;

receiving each current row serial data stream at the corresponding column driver and converting the current row serial data stream into current row parallel digital data one pixel at a time;

converting the current row parallel digital data into current row analog red, green and blue signals two adjacent pixels at a time; and sampling the current row analog red, green and blue signals and holding the samples; and providing the samples to a plurality of column electrodes for driving display.

20. The method of claim 19, comprising the further steps of:

receiving a next row of digital pixel data and storing the next row of digital pixel data in a second memory module, and performing this step while the steps of retrieving the current row of digital pixel data from the first memory module and providing each current row serial data stream are being performed;

retrieving the next row of digital pixel data in parallel from the second memory module, dividing the next row of digital pixel data into a number of next row segments, converting each next row segment into a next row serial data stream; and providing each next row serial data stream to a corresponding column driver in the plurality of column drivers, wherein each next row serial data stream is provided to a corresponding column driver via a dedicated bus line.

21. The method of claim 20, further comprising the steps of:

receiving each next row serial data stream at the corresponding column driver and converting the next row serial data stream into parallel digital data one pixel at a time;

converting the parallel digital data into analog red, green and blue signals two adjacent pixels at a time;

sampling the analog red, green and blue signals and holding the samples;

and providing the samples to the plurality of column electrodes for driving the display.

* * * * *